US007455566B2

(12) United States Patent
Nelson et al.

(10) Patent No.: US 7,455,566 B2
(45) Date of Patent: Nov. 25, 2008

(54) MAGNET TRACKING TOY AND ITS ASSOCIATED METHOD OF OPERATION

(76) Inventors: Webb T. Nelson, 19180 144th Ave., NE., Woodinville, WA (US) 98072; Simeon E. Tiefel, 5852 NE. 197th St., Woodville, WA (US) 98072

( * ) Notice: Subject to any disclaimer, the term of this patent is extended or adjusted under 35 U.S.C. 154(b) by 36 days.

(21) Appl. No.: 11/415,296

(22) Filed: May 2, 2006

(65) Prior Publication Data

US 2007/0259596 A1 Nov. 8, 2007

(51) Int. Cl.
*A63H 33/26* (2006.01)

(52) U.S. Cl. ..... 446/130

(58) Field of Classification Search ..... 446/129, 446/132–135, 137–139, 431, 433; 434/126, 434/300–302

See application file for complete search history.

(56) References Cited

U.S. PATENT DOCUMENTS 3,223,417 A * 12/1965 Riso ..... 463/61
3,469,340 A * 9/1969 Breneman et al. ..... 446/197
3,622,158 A 11/1971 Tepper ..... 273/86
3,697,071 A * 10/1972 Anderson ..... 463/60
3,760,245 A * 9/1973 Halvorsen ..... 318/38
3,882,791 A * 5/1975 Youngscap ..... 104/154
4,106,768 A * 8/1978 Kanno ..... 273/443
4,438,587 A * 3/1984 Marino ..... 446/202
4,725,256 A * 2/1988 Sassak ..... 446/176
5,441,434 A * 8/1995 Caulkins ..... 446/130
5,974,977 A * 11/1999 Johnson et al. ..... 104/60
6,056,619 A * 5/2000 Wiggs et al. ..... 446/135
6,322,415 B1 * 11/2001 Cyrus et al. ..... 446/130
6,499,409 B1 * 12/2002 Niederer et al. ..... 104/138.1

* cited by examiner

*Primary Examiner*—Kurt Fernstrom
(74) *Attorney, Agent, or Firm*—LaMorte & Associates P.C.

(57) ABSTRACT

A toy system that utilizes a vehicle that rides upon a track using a unique propulsion system. The track used by the toy has an external surface upon which the toy rides. The track also defines an internal conduit that extends the length of the track. A primary magnet is provided that is free moving within the internal conduit. The primary magnet is moved by a flow of fluid. The toy that rides along the track contains a secondary magnet. The secondary magnet and the primary magnet attract through the structure of the track, thereby causing the secondary magnet and the toy to move along the exterior surface of the track as the primary magnet travels through the conduit.

20 Claims, 5 Drawing Sheets

MAGNET TRACKING TOY AND ITS ASSOCIATED METHOD OF OPERATION

BACKGROUND OF THE INVENTION

1. Field of the Invention

The present invention relates to propulsion systems for toys and other novelty items that cause the novelty items to follow a length of track. Furthermore, the present invention relates to propulsion systems for toys that utilize magnetic fields.

2. Prior Art Background

Wheeled toys have been a favorite of children for many centuries. In that time there have been countless models, shapes, styles and sizes of wheeled toys. For many wheeled toys, such as wheeled vehicles, tracks are often created. The tracks allow for one or more wheeled toy to roll freely while being guided by the track. Often the track is little more than an inclined plane having guide rails. The wheeled toy is placed at the top of the inclined plane and is allowed to roll freely to the bottom of the inclined plane. The momentum of the rolling toy can then be used to propel the toy along the floor away from the track.

As the making of toys became industrialized, the tracks used to guide wheeled toys became more sophisticated. Continuous tracks were developed that allowed wheeled toys to travel perpetually within the confines of the track. However, continuous tracks cannot rely upon gravity to make the wheeled toys run along the track. Rather, propulsion systems had to be introduced that would allow the wheeled toys to be moved along the continuous track. There are many types of propulsion systems that have been used to move a wheeled toy, such as a car, along a track. Many of the propulsion systems are contained within the wheeled toy itself. For instance, the wheeled toy may have a wind-up motor or may contain batteries and a motor. In either case, the toy vehicle is self-moving and the track is only used to guide the direction of the wheeled toy as it moves.

In many other applications, the mechanism used to propel a wheeled toy along a track is contained within the track itself. In such applications, the propulsion mechanism must engage the wheeled toy and accelerate the wheeled toy as it passes along the continuous track. Most often, the wheeled toy is engaged by a rotating disk or grabbed by a hook that physically contacts the wheeled toy and propels it along the track. Such prior art propulsion mechanisms are exemplified by U.S. Pat. No. 3,622,158, to Tepper, entitled Racing Toy Having Vehicle Propelling Means.

In some prior art tracks, passive propulsion mechanisms are used to accelerate vehicles along the track. Passive propulsion mechanisms do not physically touch the wheeled toy, but rather propel the wheeled toy with a changing magnetic field. Such prior art propulsion mechanisms are exemplified by U.S. Pat. No. 5,974,977, to Johnson, entitled Magnetic Propulsion Toy System.

A problem associated with most all prior art prolusion mechanisms is that they are large and bulky in proportion to the track being used and the size of the wheeled toy being propelled. Furthermore, prior art propulsion mechanisms can only accelerate the wheeled toys to certain maximum speeds. Any acceleration beyond that speed may cause the wheeled toys fly off the tracks.

A need therefore exists for a wheeled toy and track system where the wheeled toy can be accelerated to great speeds without fear of the wheeled toy leaving the track. A need also exists for a propulsion mechanism for a wheeled toy that moves the wheeled toy along a track in an extremely space efficient manner. These needs are met by the present invention as described and claimed below.

SUMMARY OF THE INVENTION

The present invention is a toy vehicle that rides upon a track using a unique propulsion system. The track used by the toy has an external surface upon which the toy rides. The track also defines an internal conduit that extends the length of the track. A primary magnet is provided that is free moving within the internal conduit of the track. The primary magnet is moved by a flow of fluid that is created within the internal conduit. The flow of fluid can be created by a pump, by manual blowing or by any other mechanism that creates a pressure differential within the confines of the internal conduit.

The toy that rides along the track contains a secondary magnet. The secondary magnet and the primary magnet attract through the structure of the track, thereby causing the secondary magnet and the toy to move along the exterior surface of the track as the primary magnet travels through the conduit.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

The present invention uses a propulsion system that can propel a vehicle along a predetermined length of track. The track can be looped, and therefore continuous, wherein the propulsion system can continuously propel the vehicle around the track. However, the present invention can also be made with a short linear track, wherein the propulsion system accelerates the vehicle only along the length of the track and then lets momentum carry the vehicle a further distance. Both embodiments of the present invention are intended to be included within the scope of this disclosure. Thus, both embodiments are illustrated and described. However, it will be understood that the shown embodiments are only exemplary and that the present invention can be configured in other ways.

Figure 1:
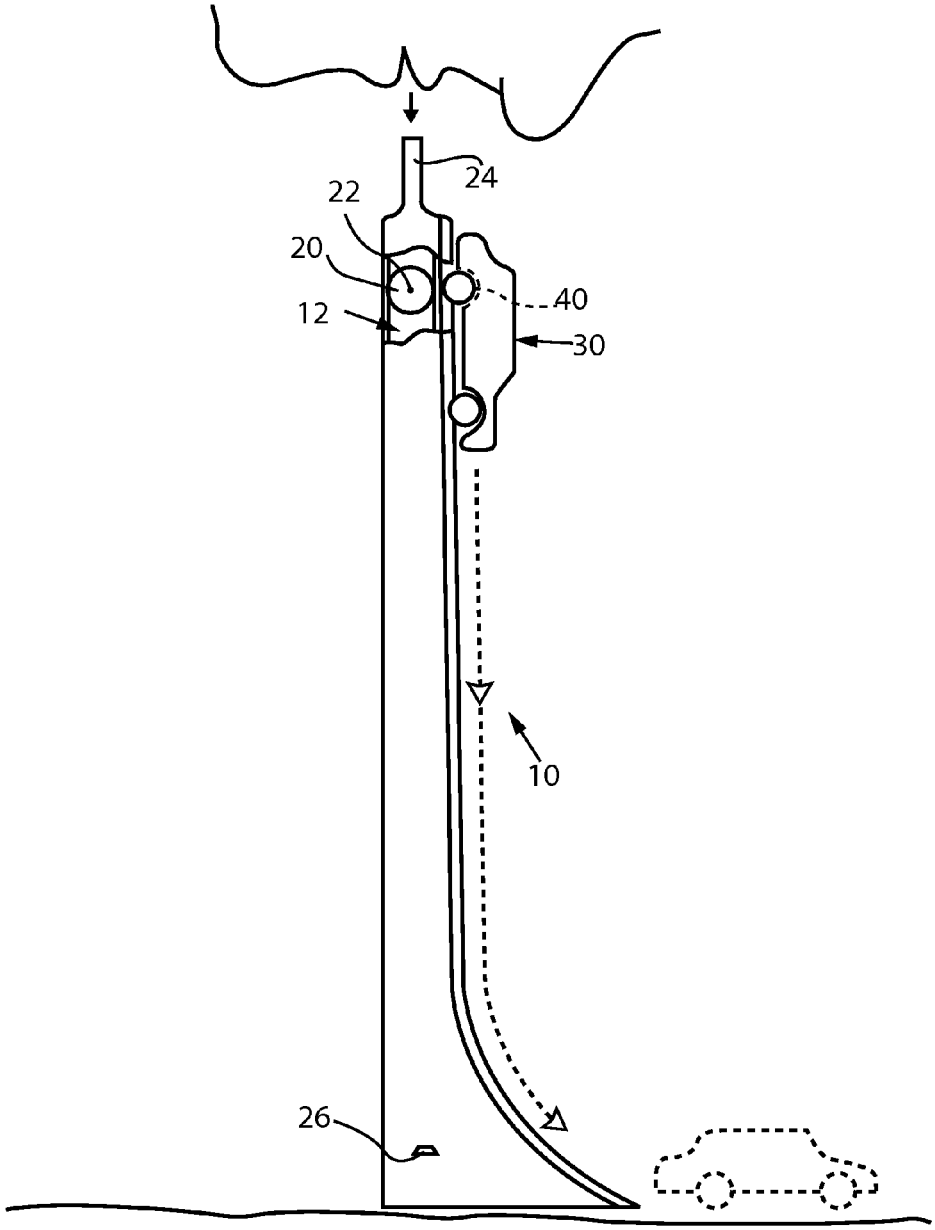
FIG. 1 is a partially fragmented side view of an exemplary embodiment of the present invention system.

Referring to FIG. 1, there is shown a length of track 10. The length of track 10 can be a few inches long or several feet long. The track 10 can be rigid and straight, or flexible and curved. Regardless of the length and rigidity of the length of track 10, the track 10 defines an internal chamber 12 having a constant cross-sectional shape. Within the internal chamber 12 is disposed a primary magnetic assembly 20. As will later be explained, the primary magnetic assembly 20 has a central axis of rotation 22 that extends in and out of the illustrated page. The primary magnetic assembly 20 preferably is shaped to roll within the internal chamber 12 around its axis of rotation 22. Accordingly, the primary magnetic assembly 20 is either round or disk-shaped to facilitate rolling along the length of the internal chamber 12.

The primary magnetic assembly 20 has two opposite sides that lay in planes parallel to the plane of the paper of the illustration. The opposite sides of the primary magnetic assembly 20 have different magnetic polarities. Accordingly, although the primary magnetic assembly 20 rolls within the internal chamber 12, the polarity at each side of the primary magnetic assembly 20 remains opposite, yet constant.

A flow access port 24 is provided that leads into the internal chamber 12. The flow access port 24 allows air, water or any other fluid medium to either be passed into or drawn from the internal chamber 12. At the opposite end of the internal chamber 12 is at least one vent port 26 that allows fluid to flow out of, or into, the internal chamber 12. As the fluid medium flows within the internal chamber 12, the flowing fluid medium moves the primary magnetic assembly 20 along the length of the internal chamber 12. The speed at which the primary magnetic assembly 20 moves is proportional to the volume of flow of the fluid medium passing within the internal chamber 12.

A toy vehicle 30 is provided that rests upon the top of the length of track 10. The shown toy vehicle 30 is a car. However, the toy vehicle 30 can be anything interesting to propel, such as a motorcycle, airplane, horse or bird. Within the toy vehicle 30 is disposed a secondary magnetic assembly 40. The secondary magnetic assembly 40 is magnetically attracted to the primary magnetic assembly 20 within the internal chamber 12. Thus, the toy vehicle 30 moves along the top of the length of track 10 as the primary magnetic assembly 20 moves within the internal chamber 12. The speed at which the toy vehicle 30 moves is directly dependent upon the speed at which the primary magnetic assembly 20 moves within the internal chamber 12.

Figure 2:
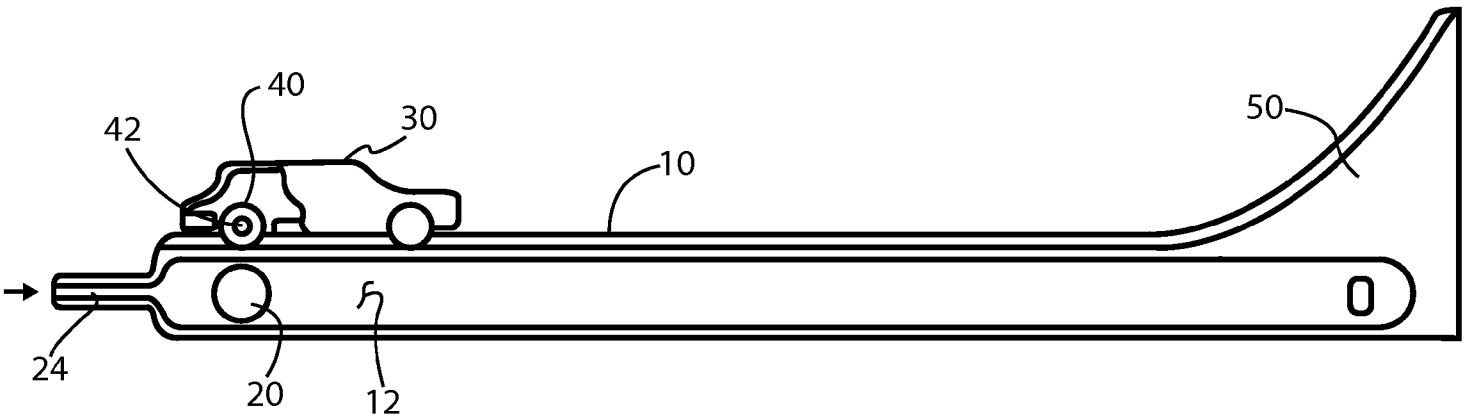
FIG. 2 is a cross-sectional view of the embodiment shown in FIG. 1.
Figure 3:
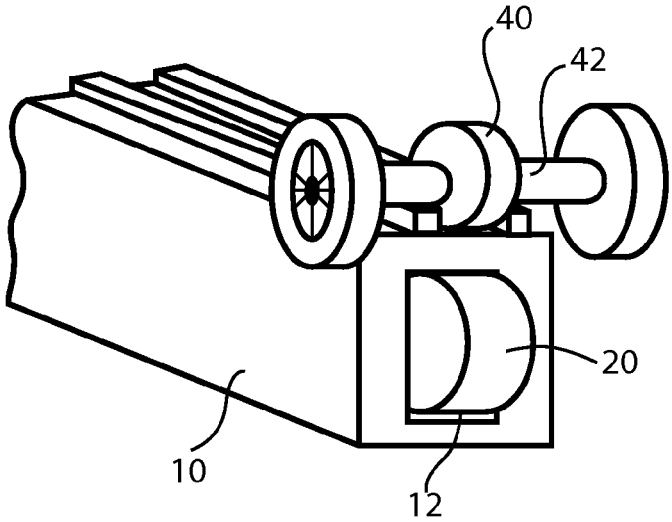
FIG. 3 is a perspective fragmented view of a section of track and toy vehicle.

Referring to FIG. 2 in conjunction with FIG. 3, it can be seen that within the toy vehicle 30 is the secondary magnetic assembly 40. The secondary magnetic assembly 40 has a central axis 42 around which it rotates. The secondary magnetic assembly 40 can be either cylindrical or spherical in shape to facilitate its rotation around the central axis 42. The central axis 42 of the secondary magnetic assembly 40 passes through two opposite sides of the secondary magnetic assembly 40. The opposite sides of the secondary magnetic assembly 40 have different magnetic polarities. Accordingly, although the secondary magnetic assembly 40 rolls upon the track 10, the polarity at each side of the secondary magnetic assembly 40 remains constant.

The side-to-side magnetic polarity of the secondary magnetic assembly 40 is made to be directly opposite that of the primary magnetic assembly 20. Thus, the positive pole of the secondary magnetic assembly 40 is positioned above the negative pole of the primary magnetic assembly 20. Similarly, the negative pole of the secondary magnetic assembly 40 is positioned above the positive pole of the primary magnetic assembly 20.

Since the secondary magnetic assembly 40 and the primary magnetic assembly 20 are magnetically attached to each other, the two magnetic assemblies 20, 40 are biased toward each other. The secondary magnetic assembly 40 is biased downwardly against the top of the track 10. Likewise, the primary magnetic assembly 20 is biased against the top of the internal chamber 12.

Since the primary magnetic assembly 20 is biased against the top of the internal chamber 12, the primary magnetic assembly 20 rotates counterclockwise as it rolls from left to right within the internal chamber 12. As the primary magnetic assembly 20 rolls within the internal chamber 12, the secondary magnetic assembly 40 is drawn by magnetic attraction and follows the primary magnetic assembly 20. The secondary magnetic assembly 40 rolls clockwise as it moves left to right following the primary magnetic assembly 20.

It will therefore be understood that when some fluid medium flows through the internal chamber 12, the primary magnetic assembly 20 is caused to move within the internal chamber 12. As the primary magnetic assembly 20 moves, the secondary magnetic assembly 40 follows the primary magnetic assembly 20, being drawn by magnetic attraction.

The secondary magnetic assembly 40 is positioned on the exterior of the track 10. A groove and/or guide rails 46 can be provided to guide the secondary magnetic assembly 40 as it rolls. This ensures that the secondary magnetic assembly 40 travels in a straight line along the track 10 as it follows after the primary magnetic assembly 20 within the track 10.

The secondary magnetic assembly 40 travels around a central axis 42. The central axis 42 is attached to the frame of a toy vehicle 30 that is to be propelled. Consequently, as the secondary magnetic assembly 40 moves to follow the primary magnetic assembly 20, the toy vehicle 30 moves along the top of the track 10. It will therefore be understood that by accelerating the primary magnetic assembly 20 within the internal chamber 12 of the track 10, the toy vehicle 30 on the outside of the track 10 will also be accelerated.

In FIG. 2, the track 10 has a defined length. At the end of the track 10 is an external ramp structure 50. By blowing into the flow access port 24, the primary magnetic assembly 20 can be accelerated from one end of the internal chamber 12 to the other. Thus, the toy vehicle 30 can also be accelerated along the length of the track 10. Once the toy vehicle 30 reaches the ramp structure 50, the secondary magnetic assembly 40 is separated from the primary magnetic assembly 20. The magnetic attraction between the secondary magnetic assembly 40 and the primary magnetic assembly 20 therefore is lessened by the separation and the momentum of the toy vehicle 30 can be used to carry the toy vehicle 30 forward and off the track 10. The track 10 can therefore be used as a launcher, wherein a toy car or plane can be accelerated along the track 10 and launched off the end of the track 10.

Figure 4:
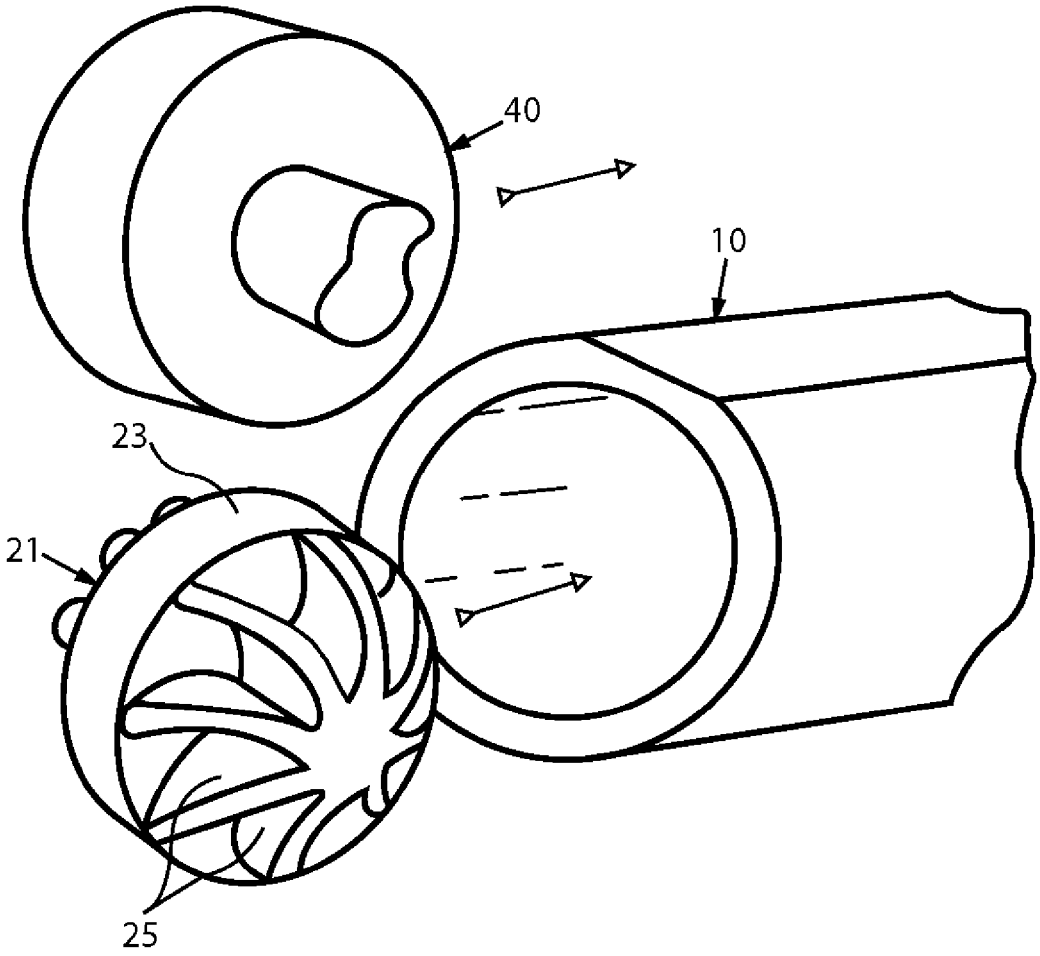
FIG. 4 is a perspective fragmented view of an alternate embodiment of a section of track and toy vehicle.

In the embodiment of FIG. 3, the primary magnet assembly 20 is disk shaped and travels through an internal chamber 12 that has a rectangular cross-sectional profile. Such shapes are merely exemplary. Referring to FIG. 4, and alternate embodiment of a primary magnet assembly 21 is shown. The alternate embodiment includes a central disk magnet 23. The central disk magnet 21 attacks the secondary magnet assembly 40 that travels on the track 10 in the same manner as has been previously explained.

In the shown alternate embodiment, vanes 25 are attached to the sides of the primary magnet assembly 21. The vanes 25 are arranged in a curved radial pattern. As such, the vanes 25 catch fluid and cause the primary magnet assembly 21 to rotate as it travels down the internal chamber within the track. The presence of the vanes 25 makes the primary magnetic assembly 21 spherical in shape. Accordingly, the internal chamber within the track would have a circular cross-sectional profile.

Figure 5:
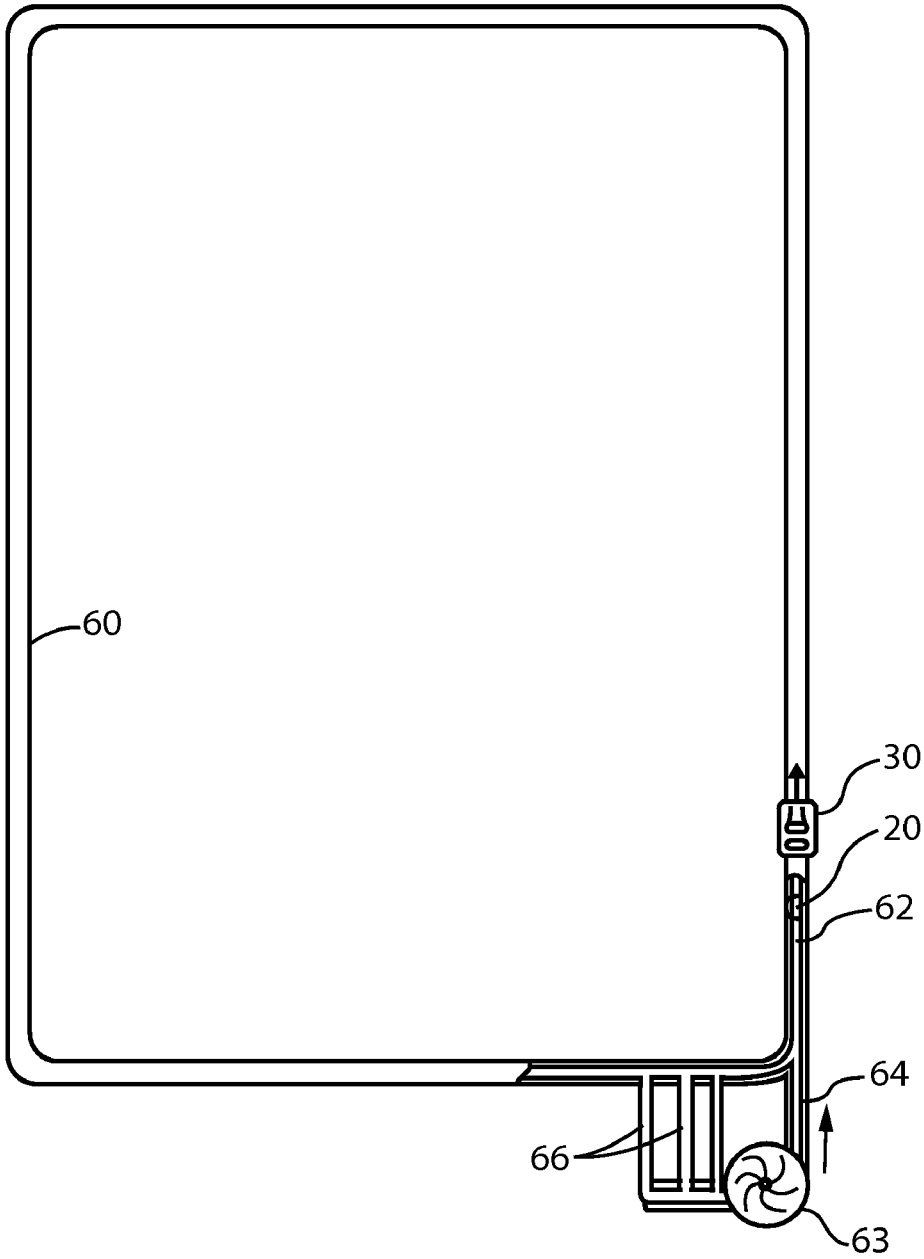
FIG. 5 is a perspective view of an alternate embodiment of the present invention system.

Referring to FIG. 5, an alternate embodiment of a track 60 is shown. In the embodiment of FIG. 5, the track 60 follows a looped configuration and therefore is continuous. The track 60 defines an internal chamber 62 of the same type as has been previously described.

A pump 63 is provided. The pump 63 pumps air or fluid through the internal chamber 62 of the track 60. In the shown embodiment, the track 60 has a single access port 64 through which air or liquid can be introduced into the internal chamber 62. Multiple vent ports 66 are provided that allows air or liquid to exit the internal chamber 62 and return to the pump 63. The access port 64 and the vent port 66 are positioned within the internal chamber 62 so that the primary magnetic assembly 20 will continuously move around the looped configuration of the track as air or liquid is introduced into the access port 64.

A toy vehicle 30 containing the secondary magnetic assembly is positioned on the exterior of the track 60. The toy vehicle follows the movement of the primary magnetic assembly 20 in the manner previously described. Thus, by blowing into the access port 64, the primary magnetic assembly 20 can be caused to repeatedly move around the looped track 60. The toy vehicle 30, which carries a secondary magnetic assembly, follows the movement of the primary magnetic assembly 20 and repeatedly travels around the exterior of the track 60.

It will be understood that the length and configuration of the track is a matter of design choice. Many looped configurations can be created. The shown use of a single simple loop is exemplary. However, complex loops and tortuous paths can be created. Similarly, the primary magnetic assembly can be moved within the track by simply blowing air into the track or drawing air out of the track. Mechanical devices, such as pumps, need not be used. All such variations, modifications and alternate embodiments are intended to be included within the scope of the present invention as defined by the claims.

What is claimed is:

1. A propulsion system for a toy, comprising:

a track that has an external surface and an internal conduit;

a primary magnet having opposite sides of opposed magnetic polarities, therein creating a first side-to-side magnetic orientation, wherein said primary magnet is free rolling about an axis of rotation that passes centrally through said opposite sides, and wherein said primary magnet substantially obstructs said conduit and is caused to travel through said conduit, when a sufficient pressure differential is created in said conduit, while consistently maintaining said first side-to-side magnetic orientation; and a secondary magnet rolling on said external surface of said track and being guided by said track, wherein said secondary magnet and said primary magnet attract through said track causing said secondary magnet to move along said exterior surface of said track as said primary magnet travels through said conduit.

2. The system according to claim 1, wherein said secondary magnet has opposite sides of opposed magnetic polarities, therein creating a second side-to-side magnetic orientation that is directly opposite said first side-to-side magnetic orientation of said primary magnet.

3. The system according to claim 2, wherein said track guides said secondary magnet and maintains said secondary magnet in said second side-to-side magnetic orientation.

4. The system according to claim 3, further including a toy coupled to said secondary magnet, wherein said toy travels along said external surface of said track with said secondary magnet.

5. The system according to claim 3, wherein fluid flows through said internal conduit, therein causing said pressure differential in said internal conduit and causing said primary magnet to move within said internal conduit.

6. The system according to claim 3, further including a pump for causing said fluid to flow in said internal conduit.

7. The system according to claim 3, wherein said track has a first end and a second end, wherein a vent is present proximate said second end that communicates with said internal conduit.

8. The system according to claim 3, wherein said primary magnet has vanes thereon that cause said primary magnet to roll within said internal conduit as fluid flows through said internal conduit.

9. A toy track assembly, comprising:

a track having an external surface, wherein said track defines and internal conduit;

a primary magnet free rolling within said internal conduit, said primary magnet having opposite sides of opposed magnetic polarities, therein creating a first side-to-side magnetic orientation, wherein internal conduit causes said primary magnet to consistently maintaining said first side-to-side magnetic orientation while rolling through said internal conduit;

a vehicle containing a secondary magnet, wherein said secondary magnet has opposite sides of opposed magnetic polarities, therein creating a second side-to-side magnetic orientation that is directly opposite said first side-to-side magnetic orientation of said primary magnet, and wherein said secondary magnet rolls upon said external surface of said track; and a flow mechanism for creating a flow of fluid through said internal conduit, wherein said flow of fluid moves said primary magnet through said internal conduit and wherein said primary magnet causes said secondary magnet within said vehicle to move with it by magnetic attraction.

10. The assembly according to claim 9, wherein said flow mechanism includes a pump for causing said fluid to flow within said internal conduit.

11. The assembly according to claim 9, wherein said flow mechanism includes a mouth blow piece that enables a person to blow air through said internal conduit.

12. The assembly according to claim 9, wherein said fluid is selected from a group consisting of air and water.

13. The assembly according to claim 9, wherein said internal conduit is configured in a continuous loop.

14. The assembly according to claim 9, wherein said track has a first end and a distant second end, wherein a vent is present proximate said second end that communicates with said internal conduit.

15. The assembly according to claim 9, wherein said primary magnet has vanes thereon that cause said primary magnet to roll within said internal conduit as fluid flows through said internal conduit.

16. A method of propelling a toy on a track, comprising the steps of:

providing a track that defines a conduit;

providing a primary magnet, within said conduit, having opposite sides of opposed magnetic polarities, therein creating a first side-to-side magnetic orientation, wherein said conduit causes said primary magnet to maintain said first side-to-side magnetic orientation when rolling through said internal conduit;

providing a toy that is magnetically attracted to said primary magnet, said toy containing a secondary magnet with opposite sides of opposed magnetic polarities, therein creating a second side-to-side magnetic orientation that is directly opposite said first side-to-side magnetic orientation of said primary magnet; and advancing said primary magnet through said conduit, wherein said toy moves on said track due to magnetic interaction between said primary magnet and said secondary magnet.

17. The method according to claim 16, wherein said step of advancing said primary magnet includes creating a fluid flow in said conduit that displaces said primary magnet through said conduit.

18. The method according to claim 16, wherein said toy contains a secondary magnet that is oriented to magnetically attract to said primary magnet.

19. The method according to claim 17, wherein said step of creating a fluid flow in said conduit includes manually blowing air through said conduit.

20. The method according to claim 17, wherein said step of creating a fluid flow in said conduit includes pumping fluid through said conduit.

* * * * *